United States Patent [19]

Nomura et al.

[11] Patent Number: 4,761,119

[45] Date of Patent: Aug. 2, 1988

[54] COMPRESSOR HAVING PULSATING REDUCING MECHANISM

[75] Inventors: Hiroshi Nomura; Susumu Saito; Susumu Echizen, all of Konan, Japan

[73] Assignee: Diesel Kiki Co., Ltd., Tokyo, Japan

[21] Appl. No.: 35,939

[22] Filed: Apr. 8, 1987

Related U.S. Application Data

[63] Continuation-in-part of Ser. No. 831,445, Feb. 20, 1986, abandoned, and a continuation-in-part of Ser. No. 831,446, Feb. 20, 1986, abandoned.

[30] Foreign Application Priority Data

Mar. 1, 1985 [JP] Japan ..... 60-29246[U]
Mar. 1, 1985 [JP] Japan ..... 60-29245[U]

[51] Int. Cl.[4] ..... F04B 27/08; F04B 39/00
[52] U.S. Cl. ..... 417/269; 417/312
[58] Field of Search ..... 417/269, 312, 313

[56] References Cited

U.S. PATENT DOCUMENTS

| | | | |
|---|---|---|---|
| 4,095,921 | 6/1978 | Hiraga et al. | 417/269 |
| 4,221,544 | 9/1980 | Ohta | 417/312 X |
| 4,274,813 | 6/1981 | Kishi et al. | 417/312 X |
| 4,283,997 | 8/1981 | Takahashi et al. | 417/269 X |
| 4,290,345 | 9/1981 | Hiraga et al. | 417/269 X |
| 4,407,638 | 10/1983 | Sasaya et al. | 417/312 X |
| 4,544,332 | 10/1985 | Shibuya | 417/312 X |
| 4,583,922 | 8/1986 | Iijima et al. | 417/312 X |

FOREIGN PATENT DOCUMENTS

| | | | |
|---|---|---|---|
| 47687 | 4/1981 | Japan | 417/312 |
| 131380 | 8/1983 | Japan | 417/269 |

*Primary Examiner*—Carlton R. Croyle
*Assistant Examiner*—Paul F. Neils
*Attorney, Agent, or Firm*—Wenderoth, Lind & Ponack

[57] ABSTRACT

A compressor of a type in which a plurality of pistons reciprocate in cylinders, the improved compressor in which a mechanism is provided to reduce pulsating of suction pressure in a cylinder head. The inside of the cylinder head is partitioned into a first low pressure chamber and a second low pressure chamber and a high pressure chamber by means of a partitioning means. The first low pressure chamber is communicated with a suction opening formed on the cylinder head, and the second low pressure chamber is communicated with a plurality of suction holes formed on a low pressure chamber are communicated by means of the suction communication hole formed on the partitioning means, and each of the suction communicating holes is positioned at an equal distance from the two suction holes, and the phase difference is provided on the pulsating produced by the passing of the gas through the suction opening.

5 Claims, 6 Drawing Sheets

COMPRESSOR HAVING PULSATING REDUCING MECHANISM

This application is a continuation-in-part of applications Ser. Nos. 831,445 and 831,446, both filed Feb. 20, 1986, and now abandoned.

BACKGROUND OF THE INVENTION

1. Field of the Invention

This invention relates to compressors for compressing gases such as coolant gas and the like, and more particularly to compressors having a mechanism for reducing pulsating of discharge pressure.

2. Prior Art

The compressors of a type in which a plurality of cylinder bores are formed in a cylinder block, and pistons are fitted to the cylinder bores, and the pistons are reciprocated with a predetermined phase difference by means of oblique plates and the like, are known as wobble type and swash plate type compressors and the like. In the compressors of this kind, the pulsating of the discharge pressure has heretofore been a problem. This pulsating causes vibration of the cooling apparatus through a piping, and becomes a cause of generation of abnormal sound. For this reason, inventions for reducing the pulsating of the discharge pressure have heretofore been proposed.

One of the inventions is disclosed in Japanese Patent Laid-Open Publication No. 58-98674. This invention has discharge holes formed in a valve plate in correspondence to each cylinder bore, and the resistance of the flow path is minimized according to the distance from the discharge holes to the discharge opening of the cylinder head, and the pulsating of the discharge pressure of each cylinder is equalized.

However, in the foregoing conventional example, distances from each discharge hole to a discharge opening are variable so that phases of the pulsating of the discharge pressure sometimes coincide and thus, the pulsating is amplified by the coincidence of the phases to generate large abnormal sounds.

SUMMARY OF THE INVENTION

An object of this invention is to prevent coincidence of the pulsating of the discharge pressure and to reduce the pulsating positively.

According to this invention, a compressor is provided having a pulsating reducing means, said compressor comprising:

a cylinder block having a plurality of a cylinder bores therein;

a plurality of pistons slidable in said cylinder bores;

means connected to said pistons for driving said pistons with a predetermined phase difference between the strokes of the respective pistons;

a valve plate on one end of said cylinder block and having a plurality of sets of at least one suction hole and at least one discharge hole, one set being positioned over the end of each of said cylinder bores;

a suction valve in each suction hole for opening and closing said suction hole;

a discharge valve in each discharge hole for opening and closing said discharge hole;

a hollow cylinder head on said one end of said cylinder block over said valve plate, said cylinder head having partitioning means for partitioning the inside of said cylinder head into a first low pressure chamber, a second low pressure chamber and a high pressure chamber, said suction holes opening into said second low pressure chamber, said discharge holes opening into said high pressure chamber, said cylinder head having inlet openings opening into said first low pressure chamber, said partitioning means having suction communicating holes between said first low pressure chamber and said second low pressure chamber, each suction communicating hole being in a non-overlapping laterally offset position, relative to the axes of the two closest adjacent cylinder bores, with respect to said suction holes and at an equal distance from the two closest adjacent suction holes. The cylinder head further has a discharge opening opening out of said high pressure chamber, said discharge opening being at an equal distance from all of said discharge holes.

Accordingly, the suction gas from the suction opening enters the first low pressure chamber firstly and then enters the second low pressure chamber by means of the suction communicating hole of the partitioning means, and is sucked into the cylinder from the second low pressure chamber but, since the suction communicating hole is at an equal distance from the two suction holes, the time of the suction gas passing the suction communicating hole has a time lag, and the phase difference is produced on the pulsating produced by the time lag whereby the object can be achieved.

Further, the high pressure gas compressed in each cylinder bore is discharged through the discharge opening by means of the high pressure chamber from each discharge hole but since the distances from each discharge hole to the discharge opening are equal, the phase difference is produced on the pulsating produced by passing the gas through the discharge opening whereby the object can be achieved.

Many other advantages, features and additional objects of this invention will become manifest to those versed in the art upon making reference to the detailed description and the accompanying drawings in which preferred structural embodiments incorporating the principles of this invention are shown by way of illustrative example.

BRIEF DESCRIPTION OF THE DRAWINGS

FIG. 1 is a cross section taken along a line I—I of FIG. 3;

FIG. 2 is a cross section taken along a line II—II of FIG. 3;

FIG. 3 is a cross section taken along a line III—III of FIG. 1;

FIG. 4 is a cross section of a cylinder block used in the embodiment; and

DETAILED DESCRIPTION

Figure 1:
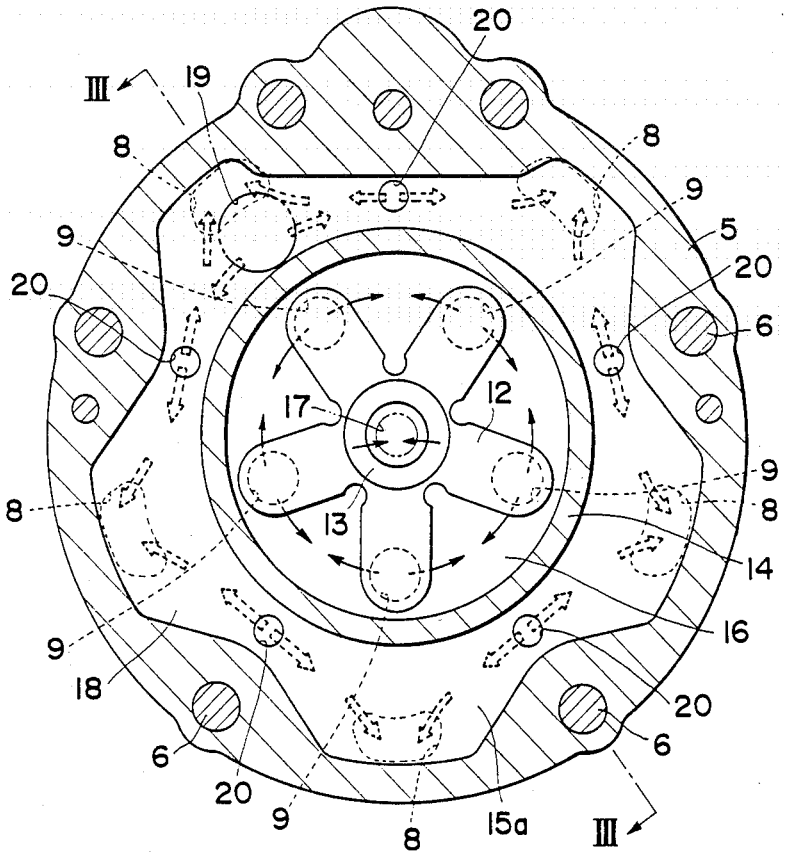
FIG. 1 through FIG. 4 show an embodiment of this invention.

In FIG. 1 through FIG. 4, an embodiment of this invention is illustrated, and the compressor is a known wobble type, and for example, five cylinder bores 2 are formed in parallel in and equidistantly spaced around the cylinder block 1, and a piston 3*a* of the piston means 3 is slidably inserted in each bore. The piston 3*a* is connected to a piston rod 3*b*, and the other end of the piston rod 3*b* is engaged with or abuts an oblique plate not shown, and the adjacent pistons 3*a* reciprocate in the cylinder bores 2 with a predetermined phase difference.

The valve plate 4 is sandwiched between the cylinder block 1 and a cylinder head 5 to be described hereinafter, and is fixed to one end of the cylinder block 1 together with the cylinder head 5 by means of connecting bolts 6, and one end of the cylinder bores 2 is closed, and a compression chamber 7 is formed in each bore by end surfaces of the cylinder bore 2, and piston 3*a* and an inner surface of the valve plate 4. This valve plate 4 is provided with a suction hole 8 and a discharge hole 9 at diametrically opposite positions of each cylinder bore 2, and thus, the number of the suction holes 8 and the discharge holes 9 is five respectively.

The suction holes 8 are closed by a star type suction valve 10 sandwiched between the cylinder block 1 and the valve plate 4. This suction valve 10 is openable, and in the suction stroke where each piston 3*a* retreats and the volume of the compression chamber 7 is enlarged, opens the suction hole 8 to suck the gas into the compression chamber 7, and in the compression discharge stroke where the piston 3*a* advances to decrease the volume of the compression chamber 7, closes the suction hole 8. On the other hand, although each discharge hole 9 is also closed by a star type discharge valve 11, it is provided on the surface of the valve plate 4, and on the back portion of the discharge valve 11, a valve stopper 12 is provided and is fixed to the cylinder block 1 together with the valve stopper 12 by means of a mounting screw 13, and in the suction stroke, closes the corresponding discharge hole 9, and in the compression discharge stroke, opens the discharge hole 9 by a limited area corresponding to the opening.

The cylinder head 5 has an integrally formed circular bulkhead 14 centering around the mounting screw 13, and the inside of the cylinder head 5, namely, the space defined by the valve plate 4 and the cylinder head 5 is partitioned into a low pressure chamber 15 around its peripheral edge and a high pressure chamber 16 in the middle. The high pressure chamber 16 is communicated with all the discharge holes 9 which are covered by the valve stopper 12. Also, this high pressure chamber 16 is communicated with a discharge opening 17 formed in the center of the end surface of the cylinder head 5, and the discharge opening 17 is at an equal distance from all the discharge holes 9.

Figure 1A:
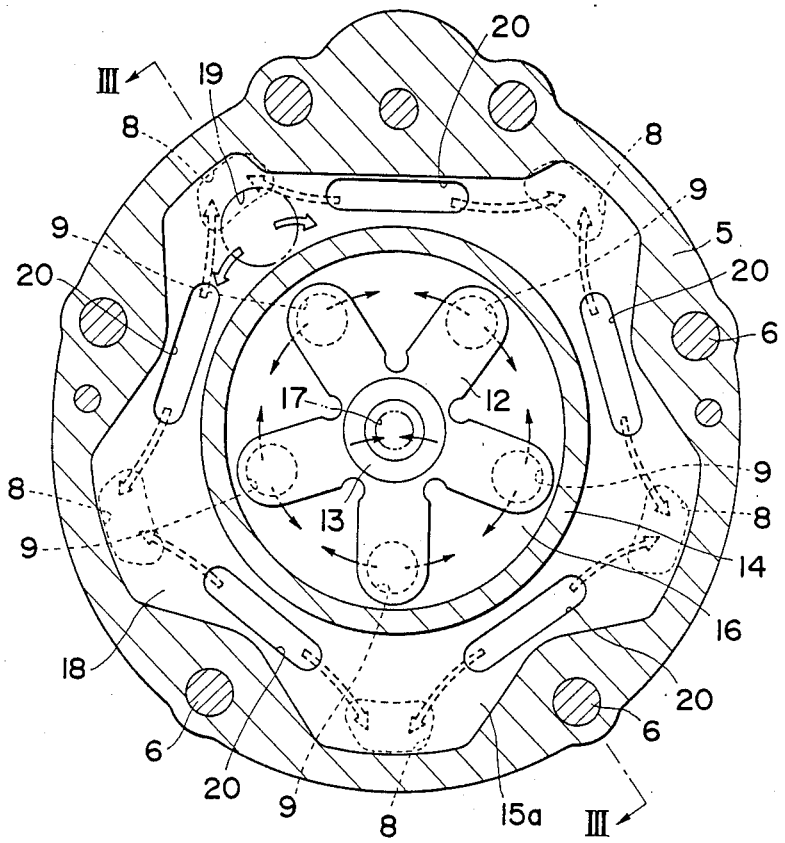
FIG. 1*a* is a cross section similar to that of FIG. 1 showing an alternative form of suction communicating hole.
Figure 2:
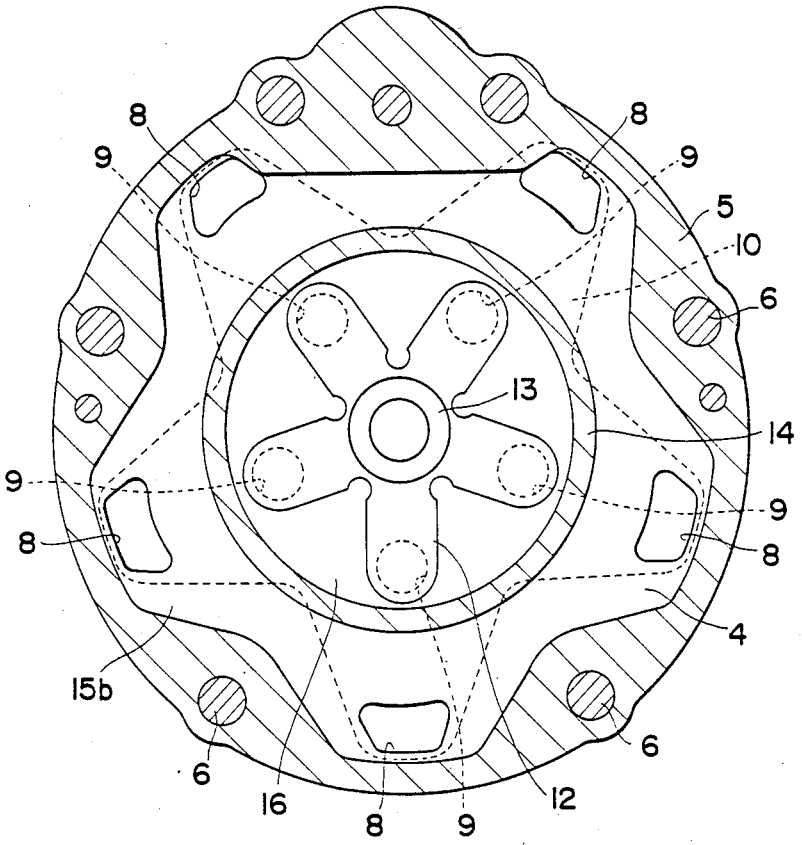

The low pressure chamber 15 is partitioned into a first low pressure chamber 15*a* and a second low pressure chamber 15*b* in the longitudinal direction of th compressor by means of a partition plate 18 fixed to an inner wall of the cylinder head 5. The first low pressure chamber 15*a* is defined by the cylinder head 5 and the partition plate 18, and is communicated with a suction opening 19 formed in the end surface of the cylinder head 5. The second low pressure chamber 15*b* is defined by the valve plate 4, cylinder head 5 and partition plate 18, and is communicated with all the suction holes 8. The first low pressure chamber 15*a* and the second low pressure chamber 15*b* are communicated by means of a plurality of five suction communicating holes 20 formed in the partition plate 18 as shown in FIG. 1. Each suction communicating hole 20 is preferably circumferentially elongated, as shown in FIG. 1*a*, to minimize resistance to the suction gas, and the holes 20 are at equal circumferential distances in the circumferential direction so as to be at an equal distance from the adjacent suction holes 8.

Figure 3:
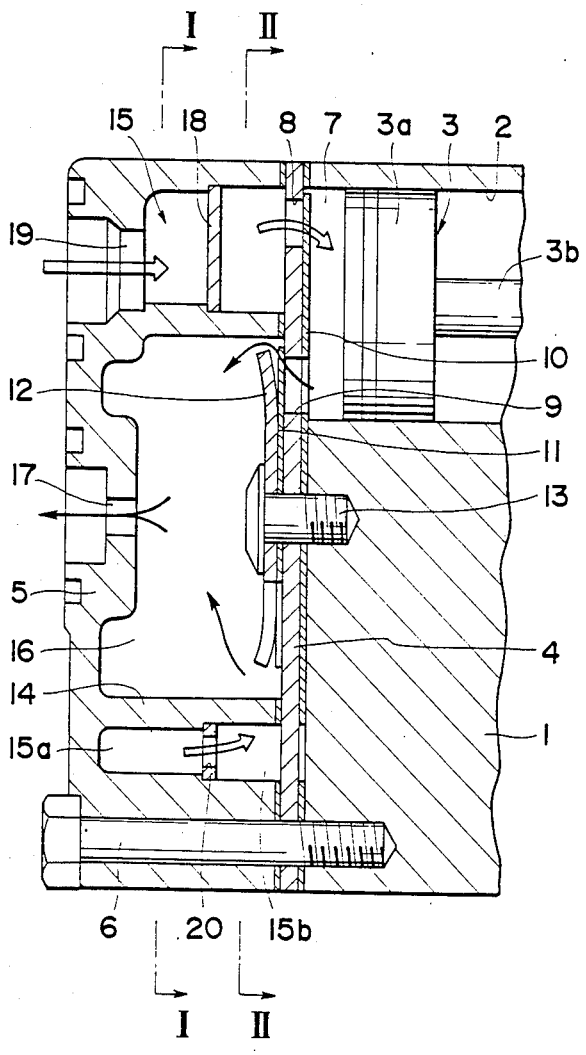
Figure 4:
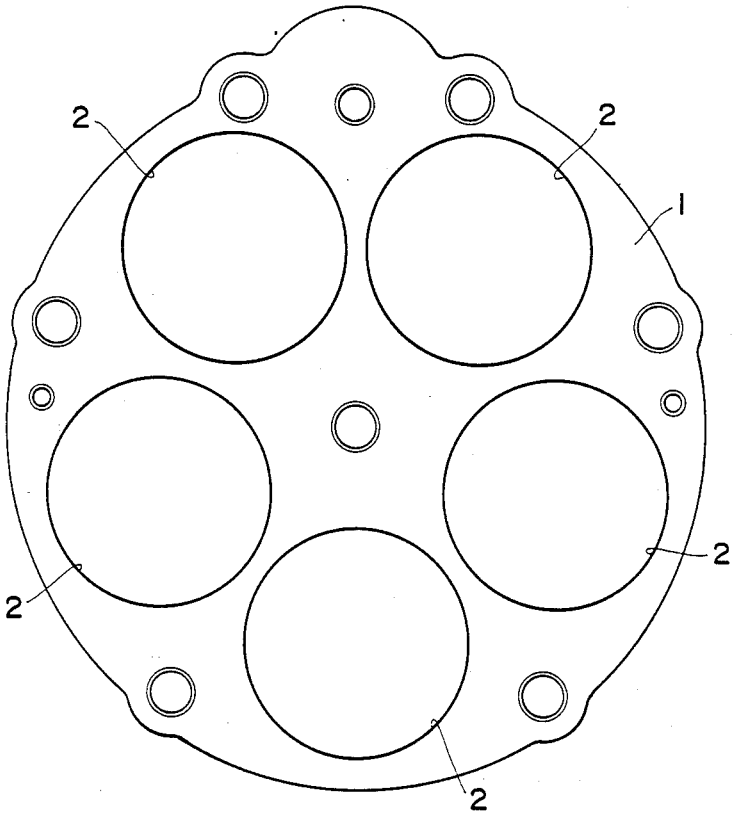

Next, the operation of the foregoing embodiment will be described. In FIG. 1 and FIG. 3, the arrow mark white-on-black show the flow of the suction gas, and the arrow mark black-on-white shows the flow of the discharge gas respectively.

When a drive shaft not shown is rotated, each piston 3*a* reciprocates in a cylinder bore 2 at a phase difference of 72 degrees relative to the adjacent pistons. When each piston starts a suction stroke, the volume of the compression chamber 7 is enlarged so that the pressure in the compression chamber 7 is lowered, and the suction valve 10 opens to suck the gas into the compression chamber 7. At this time, the suction gas enters the first low pressure chamber 15*a* from the suction opening 19 and is stored temporarily in the first low pressure chamber 15*a*, and reaches the second low pressure chamber 15*b* through the suction communicating holes 20, and reaches the compression chamber 7 by means of the suction hole 8 from the second low pressure chamber 15*b*. Next, when the piston starts the compression stroke, the volume of the compression chamber 7 is decreased so that the pressure in the compression chamber 7 becomes high so as to open the discharge valve 11 and the gas at high pressure is discharged through the discharge opening 17 from the discharge hole 9 through the high pressure chamber 16.

As described in the foregoing, the suction gas passes the suction communicating hole 20 in a passage from the suction opening 19 to the suction holes 8, but this suction communicating hole 20 is formed at an equal distance from the adjacent suction holes 8. Accordingly, in one suction communicating hole 20, for example, in the stage where the flow of the suction gas to the suction hole 8 on the left side is almost completed, the flow of the suction gas to the suction hole 8 on the right side is started, and the phase difference corresponding to the reciprocation of the piston 3 is generated between the flow of the right and left, and for this reason, the pulsating of the suction pressure can be prevented.

Moreover, since the distances from all the discharge holes 9 to the discharge opening 17 are equal, in the stage where the flow of the discharge gas from one discharge hole 9 is almost completed, the flow of the discharge gas from the next discharge hole 9 is started, and the phase difference corresponding to the reciprocation of the pistons 3 is generated in the flow, and for this reason, the pulsating of the discharge pressure can be prevented.

Figure 5:
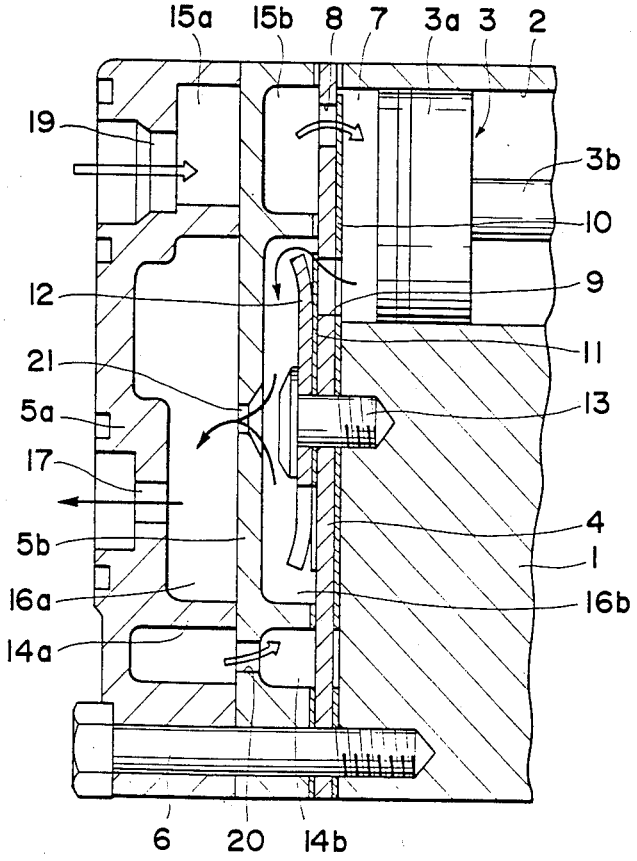
FIG. 5 is a cross section showing another embodiment.

In FIG. 5, another embodiment of this invention is illustrated, in which the means for partitioning the inside of the cylinder head 5 is different. Namely, in this embodiment, the cylinder head 5 is divided into two parts, the first cylinder head member 5*a* and the second cylinder head member 5*b*, and the first low pressure chamber 15*a* and the first high pressure chamber 16*a* are formed in the first cylinder head member 5*a* by means of the first bulkhead 14*a*, and the second low pressure chamber 15*b* and the second high pressure chamber 16*b* are formed in the second cylinder head member 5*b* by means of the second bulkhead 14*b*, and the first low pressure chamber 15*a* and the first high pressure chamber 16*a* and the second low pressure chamber 15*b* and the second high pressure chamber 16*b* are partitioned by the end surface of the second cylinder head member 5*b*. In the center of the end surface of the second cylinder head member 5*b*, besides the suction communicating holes 20, is formed a first discharge opening 17*a* communicating the first high pressure chamber 16*a* and the second high pressure chamber 16b, so that the first discharge opening 17a is disposed at an equal distance from all the discharge holes 9. The second discharge opening 17b is eccentrically formed in the first cylinder head member 5a. In this embodiment, since the direction of flow of the discharge gas is arranged to change sharply, an effect of muffling the sound can be obtained.

Obviously, many modifications and variations of the present invention are possible in the light of above teachings. It is therefore to be understood that within the scope of the appended claims, the invention may be practiced otherwise than as specifically described.

What is claimed:

1. A compressor having a pulsating reducing means, said compressor comprising:

a cylinder block having a plurality of cylinder bores therein;

a plurality of pistons slidable in said cylinder bores;

means connected to said pistons for driving said pistons with a predetermined phase difference between the strokes of the respective pistons;

a valve plate on one end of said cylinder block and having a plurality of sets of at least one suction hole and at least one discharge hole, one set being positioned over the end of each of said cylinder bores;

a suction valve in each suction hole for opening and closing said suction hole;

a discharge valve in each discharge hole for opening and closing said discharge hole;

a hollow cylinder head on said one end of said cylinder block over said valve plate, said cylinder head having partitioning means for partitioning the inside of said cylinder head into a first low pressure chamber, a second low pressure chamber and a high pressure chamber, said suction holes opening into said second low pressure chamber, said discharge holes opening into said high pressure chamber and said cylinder head having an inlet opening opening into said first low pressure chamber and a discharge opening opening out of said high pressure chamber, said partitioning means having suction communicating holes between said first low pressure chamber and said second low pressure chamber, each suction communicating hole being in a non-overlapping laterally offset position, relative to the axes of the two closest adjacent cylinder bores, with respect to said suction holes and at an equal distance from the two closest adjacent suction holes.

2. A compressor as claimed in claim 1 in which said partitioning means is a partitioning plate fixed to the inner surface of the circumferential wall of said cylinder head.

3. A compressor as claimed in claim 1 in which said cylinder head is constituted by a first cylinder head member and a second cylinder head member between said first cylinder head member and said cylinder block and constituting said partitioning means.

4. A compressor having pulsating reducing means, said compressor comprising:

a cylinder block having a plurality of cylinder bores therein;

a plurality of pistons slidable in said cylinder bores;

means connected to said pistons for driving said pistons with a predetermined phase difference between the strokes of the respective pistons;

a valve plate on one end of said cylinder block and having a plurality of sets of at least one suction hole and at least one discharge hole, one set being positioned over the end of each of said cylinder bores;

a suction valve in each suction hole for opening and closing said suction hole;

a discharge valve in each discharge hole for opening and closing said discharge hole;

a hollow cylinder head on said one end of said cylinder block over said valve plate, said cylinder head having partitioning means for partitioning the inside of said cylinder head into a first low pressure chamber, a second low pressure chamber and a high pressure chamber, said suction holes opening into said second low pressure chamber, said discharge holes opening into said high pressure chamber, said partitioning means having suction communicating holes between said first low pressure chamber and said second low pressure chamber, each suction communicating hole being in a non-overlapping laterally offset position, relative to the axes of the two closest adjacent cylinder bores, with respect to said suction holes and at an equal distance from the two closest adjacent suction holes, said cylinder head having an inlet opening opening into said first low pressure chamber and a discharge opening opening out of said high pressure chamber, said discharge opening being at an equal distance from all of said discharge holes.

5. A compressor as claimed in claim 4 in which said suction communicating holes are elongated in the circumferential direction of said cylinder head.

* * * * *